US010428818B2

(12) United States Patent
Jin et al.

(10) Patent No.: US 10,428,818 B2
(45) Date of Patent: Oct. 1, 2019

(54) SCROLL COMPRESSOR

(71) Applicant: LG ELECTRONICS INC., Seoul (KR)

(72) Inventors: Honggyun Jin, Seoul (KR); Sangwoo Joo, Seoul (KR)

(73) Assignee: LG Electronics Inc., Seoul (KR)

( * ) Notice: Subject to any disclaimer, the term of this patent is extended or adjusted under 35 U.S.C. 154(b) by 105 days.

(21) Appl. No.: 15/388,584

(22) Filed: Dec. 22, 2016

(65) Prior Publication Data

US 2017/0241417 A1 Aug. 24, 2017

(30) Foreign Application Priority Data

Feb. 24, 2016 (KR) ..... 10-2016-0022081

(51) Int. Cl.
*F04C 28/24* (2006.01)
*F04C 28/26* (2006.01)
(Continued)

(52) U.S. Cl.
CPC ..... *F04C 28/26* (2013.01); *F04C 18/0215* (2013.01); *F04C 18/0261* (2013.01);
(Continued)

(58) Field of Classification Search
CPC .. F04C 18/0261; F04C 18/0215; F04C 28/26; F04C 14/24; F04C 28/24; F25B 49/022
(Continued)

(56) References Cited

U.S. PATENT DOCUMENTS 5,613,841 A * 3/1997 Bass ..... F01C 21/102 417/310
6,412,293 B1 7/2002 Pham et al.
(Continued)

FOREIGN PATENT DOCUMENTS

CN 1272906 11/2000
CN 1348064 5/2002
(Continued)

OTHER PUBLICATIONS

Korean Office Action dated Aug. 11, 2017 issued in Application No. 10-2016-0066713.
(Continued)

*Primary Examiner* — Deming Wan
(74) *Attorney, Agent, or Firm* — KED & Associates, LLP

(57) ABSTRACT

A scroll compressor according to the present invention includes a casing having a hermetic inner space divided into a low pressure portion and a high pressure portion, an orbiting scroll disposed within the inner space of the casing and performing an orbiting motion, a non-orbiting scroll forming a compression chamber together with the orbiting scroll, the compression chamber having a suction chamber, an intermediate pressure chamber and a discharge chamber, a back pressure chamber assembly coupled to the non-orbiting scroll to form a back pressure chamber, a valve accommodation groove formed on at least one of the non-orbiting scroll or the back pressure chamber assembly, a bypass hole formed from the intermediate pressure chamber into the valve accommodation groove in a penetrating manner, a check valve accommodated in the valve accommodation groove and opening and closing the bypass hole according to pressure of the intermediate pressure chamber, a communication passage communicating the valve accommodation groove and the low pressure portion with each other, and a control valve selectively opening and closing the
(Continued)

communication passage, whereby a facilitated fabrication, improved responsiveness and relaxed restriction for a specification of a valve can be achieved.

8 Claims, 10 Drawing Sheets

(51) Int. Cl.

| | |
|---|---|
| ***F04C 18/02*** | (2006.01) |
| ***F04C 23/00*** | (2006.01) |
| ***F04C 28/10*** | (2006.01) |
| ***F04C 29/12*** | (2006.01) |

(52) U.S. Cl.
CPC ..... *F04C 18/0292* (2013.01); *F04C 23/008* (2013.01); *F04C 28/10* (2013.01); *F04C 29/126* (2013.01); *F04C 2240/30* (2013.01); *F04C 2240/808* (2013.01)

(58) Field of Classification Search
USPC ..... 418/55.1–55.6, 149, 177, 63, 110, 131
See application file for complete search history.

(56) References Cited

U.S. PATENT DOCUMENTS

| | | | | |
|---|---|---|---|---|
| 7,674,098 | B2 * | 3/2010 | Lifson | F04C 28/26 417/310 |
| 8,156,751 | B2 | 4/2012 | Jayanth | |
| 9,920,759 | B2 | 3/2018 | Sung et al. | |
| 2004/0042911 | A1 | 3/2004 | Hong et al. | |
| 2007/0183915 | A1 * | 8/2007 | Guo | F04C 18/0215 418/55.6 |
| 2009/0110570 | A1 | 4/2009 | Cho | |
| 2010/0028182 | A1 * | 2/2010 | Hahn | F04C 18/0215 418/55.1 |
| 2010/0300659 | A1 | 12/2010 | Stover et al. | |
| 2010/0303659 | A1 | 12/2010 | Stover et al. | |
| 2011/0058972 | A1 * | 3/2011 | Patel | F04C 18/0215 418/16 |
| 2014/0154121 | A1 | 6/2014 | Doepker | |
| 2015/0192121 | A1 | 7/2015 | Sung et al. | |
| 2016/0025093 | A1 | 1/2016 | Doepker | |

FOREIGN PATENT DOCUMENTS

| | | |
|---|---|---|
| CN | 1479014 | 3/2004 |
| CN | 101424265 | 5/2009 |
| CN | 101514701 | 8/2009 |
| CN | 102422024 | 4/2012 |
| CN | 102449314 | 5/2012 |
| CN | 202707487 | 1/2013 |
| EP | 0 144 169 | 6/1985 |
| EP | 1 004 773 | 5/2000 |
| EP | 1 197 661 | 4/2002 |
| EP | 2 093 427 | 8/2009 |
| JP | S59-203893 | 11/1984 |
| JP | H 01-106990 | 4/1989 |
| JP | H 05-340363 | 12/1993 |
| JP | H 08-303361 | 11/1996 |
| JP | 2003-083269 | 3/2003 |
| KR | 10-0308289 | 8/2001 |
| KR | 10-0360861 | 10/2002 |
| KR | 10-2004-0091361 | 10/2004 |
| KR | 10-0469461 | 2/2005 |
| KR | 10-1056882 | 8/2011 |
| KR | 10-2012-0008045 | 1/2012 |
| KR | 10-2014-0114740 | 9/2014 |
| KR | 10-2015-0126228 | 11/2015 |
| WO | WO 2009/155109 | 12/2009 |

OTHER PUBLICATIONS

Korean Office Action dated Aug. 14, 2017 issued in Application No. 10-2016-0064343.
European Search Report dated Sep. 19, 2017 issued in Application No. 17154222.8.
European Search Report dated Oct. 5, 2017 issued in Application No. 17154229.3.
Korean Notice of Allowance dated Feb. 14, 2018 issued in Application No. 10-2016-0066713.
Korean Office Action issued in Application 10-2016-0022081 dated Mar. 24, 2017.
Notice of Allowance dated May 30, 2017 issued in Application No. 10-2016-0022081.
European Search Report dated Jun. 27, 2017 issued in Application No. 17154150.1.
United States Office Action dated Sep. 25, 2018 issued in co-pending related U.S. Appl. No. 15/390,221.
Chinese Office Action dated Jun. 5, 2018 issued in Application No. 201710104227.4 (with English Translation).
Chinese Office Action dated Jul. 27, 2018 issued in Application No. 201710191912.5 (with English Translation).
Chinese Office Action dated Sep. 25, 2018 issued in Application No. 201710191859.9 (with English Translation).
U.S. Office Action dated Sep. 26, 2018 issued in co-pending related U.S. Appl. No. 15/390,246.

* cited by examiner

SCROLL COMPRESSOR

CROSS-REFERENCE TO RELATED APPLICATION

Pursuant to 35 U.S.C. § 119(a), this application claims the benefit of an earlier filing date of and the right of priority to Korean Application No. 10-2016-0022081, filed in Korea on Feb. 24, 2016, the contents of which are incorporated by reference herein in its entirety.

BACKGROUND

1. Field

This specification relates to a scroll compressor, and more particularly, a capacity varying apparatus for a scroll compressor.

2. Background

A scroll compressor is a compressor which is provided with a non-orbiting scroll provided in an inner space of a casing, and an orbiting scroll engaged with the non-orbiting scroll to perform an orbiting motion so as to form a pair of compression chambers, each of which includes a suction chamber, an intermediate pressure chamber and a discharge chamber, between a non-orbiting wrap of the non-orbiting scroll and an orbiting wrap of the orbiting scroll.

Compared with other types of compressors, the scroll compressor is widely used for refrigerant compression in an air-conditioning apparatus and the like, by virtue of advantages of obtaining a relatively high compression ratio and stable torques resulting from smoothly-performed suction, compression and discharge strokes of a refrigerant.

Scroll compressors may be classified into a high pressure type and a low pressure type according to a type of supplying a refrigerant into a compression chamber. The high pressure type compressor employs a method in which a refrigerant is introduced directly into a suction chamber without passing through an inner space of a casing and then discharged via the inner space of the casing. In this type compressor, most of the inner space of the casing forms a high pressure portion as a discharge space. On the other hand, the low pressure type scroll compressor employs a method in which a refrigerant is introduced indirectly into the suction chamber via the inner space of the casing. In this type compressor, the inner space of the casing is divided into a low pressure portion as a suction chamber and a high pressure portion as a discharge space by a high/low pressure dividing plate.

FIG. 1 is a longitudinal sectional view of a low pressure type scroll compressor according to the related art.

As illustrated in FIG. 1, the low pressure type scroll compressor according to the related art includes a driving motor 20 disposed in an inner space 11 of a hermetic casing 10 to generate a rotation force, and a main frame 30 disposed at an upper side of the driving motor 20.

The orbiting wrap 40 is disposed on an upper surface of the main frame 30 to be orbited by an Oldham-ring (not illustrated), and the non-orbiting scroll 50 is provided on an upper side of the orbiting scroll 40 to be engaged with the orbiting scroll 40 and thus form compression chambers P.

A rotation shaft 25 is coupled to a rotor 22 of the driving motor 20, the orbiting scroll 40 is eccentrically coupled to the rotation shaft 25, and the non-orbiting scroll 50 is coupled to the main frame 30 in a manner of being restricted from being orbited.

A back pressure chamber assembly 60 for preventing the non-orbiting scroll 50 from being raised up due to pressure of the compression chamber P during an operation is coupled to an upper side of the non-orbiting scroll 50. The back pressure chamber assembly 60 is provided with a back pressure chamber 60*a* in which a refrigerant of intermediate pressure is filled.

A high/low pressure dividing plate 15 is provided on an upper side of the back pressure chamber assembly 60. The high/low pressure dividing plate 15 supports a rear surface of the back pressure chamber assembly 60 and simultaneously divides the inner space 11 of the casing 10 into a low pressure portion 11 as a suction space and a high pressure portion 12 as a discharge space.

The high/low pressure dividing plate 15 has an outer circumferential surface attached to an inner circumferential surface of the casing 10 in a welding manner, and is provided with a discharge hole 15*a* formed through a central portion thereof to communicate with a discharge port 54 of the non-orbiting scroll 50.

In the drawing, a non-explained reference numeral 13 denotes a suction pipe, 14 denotes a discharge pipe, 18 denotes a sub frame, 21 denotes a stator, 21*a* denotes a winding coil, 41 denotes a disk portion of the orbiting scroll, 42 denotes the orbiting wrap, 51 denotes a disk portion of the non-orbiting scroll, 52 denotes the non-orbiting wrap, 53 denotes a suction port, and 61 denotes a modulation ring for varying a capacity.

With the configuration of the related art scroll compressor, when a rotation force is generated in the driving motor 20 in response to power supplied to the driving motor 20, the rotation shaft 25 transfers the rotation force of the driving motor 20 to the orbiting scroll 40.

The orbiting scroll 40 then performs an orbiting motion with respect to the non-orbiting scroll 50 by the Oldham-ring. Accordingly, a pair of compression chambers P is formed between the orbiting scroll 40 and the non-orbiting scroll 50 such that a refrigerant can be sucked, compressed and discharged.

In this instance, the refrigerant compressed in the compression chambers P is partially introduced from the intermediate pressure chamber into the back pressure chamber 60*a* through a back pressure hole (not illustrated). The refrigerant of intermediate pressure introduced into the back pressure chamber 60*a* generates back pressure to lift a floating plate 65 constructing the back pressure chamber assembly 60. The floating plate 65 is closely adhered on a lower surface of the high/low pressure dividing plate 15 such that the high pressure portion 12 and the low pressure portion 11 are divided from each other. Simultaneously, pressure of the back pressure chamber pushes the non-orbiting scroll 50 toward the orbiting scroll 40, to maintain the compression chamber P between the non-orbiting scroll 50 and the orbiting scroll 40 in an air-tight state.

Here, the scroll compressor, similar to other types of compressors, may vary a compression capacity according to requirement of a refrigerating device with the compressor. For example, as illustrated in FIG. 1, the modulation ring 61 and a lift ring 62 are additionally provided on the disk portion 51 of the non-orbiting scroll 50, and a control valve 63 which communicates with the back pressure chamber 60*a* through a first communication passage 61*a* is provided on one side of the modulation ring 61. A second communication passage 61*b* is formed between the modulation ring 61 and the lift ring 62, and a third communication passage 61*c* which is open when the modulation ring 61 rises is formed between the modulation ring 61 and the non-orbiting scroll 50. One end of the third communication passage 61*c* communicates with the intermediate compression chamber P and another end thereof communicates with the low pressure portion 11 of the casing 10.

During a power operation (mode) of the scroll compressor, as illustrated in FIG. 2A, the control valve 63 closes the first communication passage 61*a* and opens the second communication passage 61*b* to communicate with the low pressure portion 11, thereby preventing the modulation ring 61 from being raised up. Accordingly, the third communication passage 61*c* is maintained in a closed state.

On the other hand, during a power-saving operation (mode) of the scroll compressor, as illustrated in FIG. 2B, the control valve 63 communicates the first communication passage 61*a* with the second communication passage 61*b*. Accordingly, the modulation ring 61 is raised up to open the third communication passage 61*c*, such that the refrigerant within the intermediate compression chamber P is partially leaked into the low pressure portion 11. This results in a reduction of a capacity of the compressor.

However, the capacity varying apparatus of the related art scroll compressor which includes the modulation ring 61, the lift ring 62 and the control valve 63 requires such a lot of components. Also, the first communication passage 61*a*, the second communication passage 61*b* and the third communication passage 61*c* should be formed on the modulation ring 61 to operate the modulation ring 61, which makes the structure of the modulation ring 61 complicated.

Furthermore, the capacity varying apparatus of the related art scroll compressor should fast lift the modulation ring 61 using the refrigerant of the back pressure chamber 60*a*. However, as the modulation ring 61 is formed in a ring shape and coupled with the control valve 63, a weight of the modulation ring 61 increases which makes it difficult to fast lift the modulation ring 61. In addition, a passage for lifting the modulation ring 61 is long and even the refrigerant should be introduced into a space between the modulation ring 61 and the lift ring 62 to lift the modulation ring 61, but the pressure of the back pressure chamber 60*a* still exists on the upper surface of the modulation ring 61. Therefore, the lifting of the modulation ring 61 is not easy and responsiveness of the valve is lowered, which results in interfering with a fast control of the variation of the capacity of the compressor.

BRIEF DESCRIPTION OF THE DRAWINGS

Embodiments will be described in detail with reference to the following drawings in which like reference numerals refer to like elements, and wherein.

DETAILED DESCRIPTION

Description will now be given in detail of a scroll compressor according to exemplary embodiments disclosed herein, with reference to the accompanying drawings.

Figure 1:
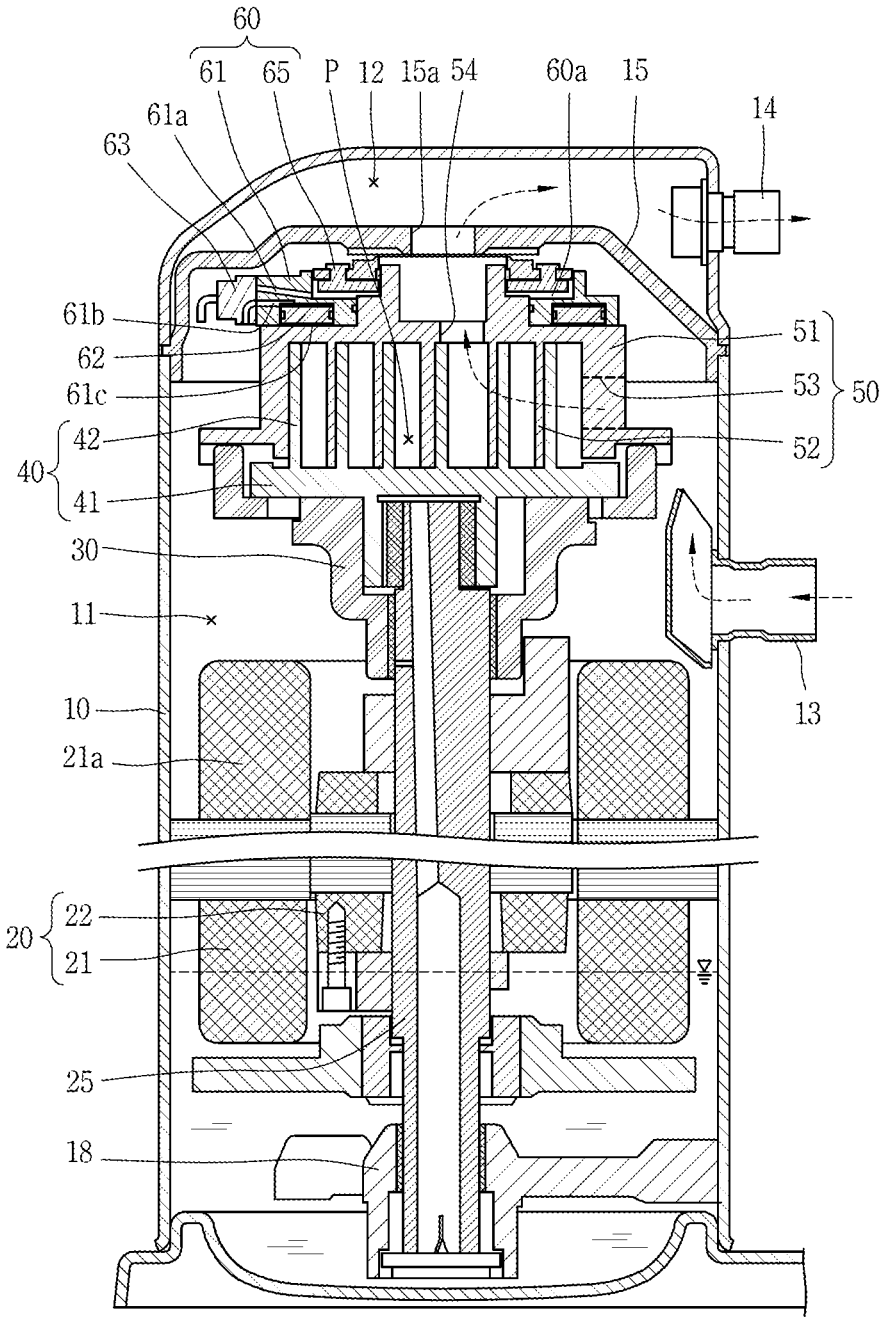
FIG. 1 RELATED ART
FIG. 1 is a longitudinal sectional view of a scroll compressor having a capacity varying apparatus according to the related art.
Figure 2A:
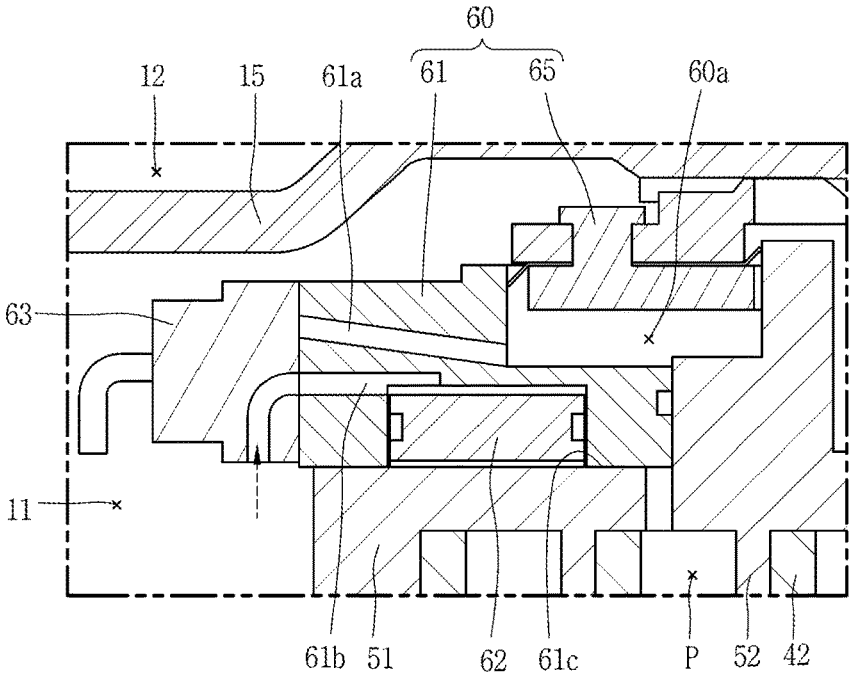
FIG. 2A RELATED ART
FIGS. 2A and 2B are longitudinal sectional views illustrating a power-operation state and a saving-operation state using the capacity varying apparatus in the scroll compressor of FIG. 1.
Figure 2B:
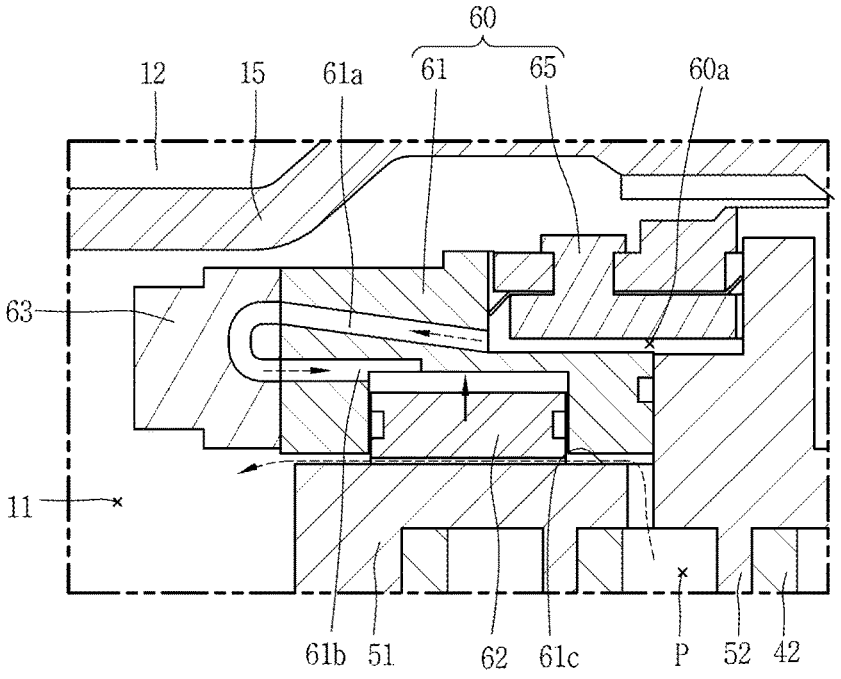
FIG. 2B RELATED ART
Figure 3:
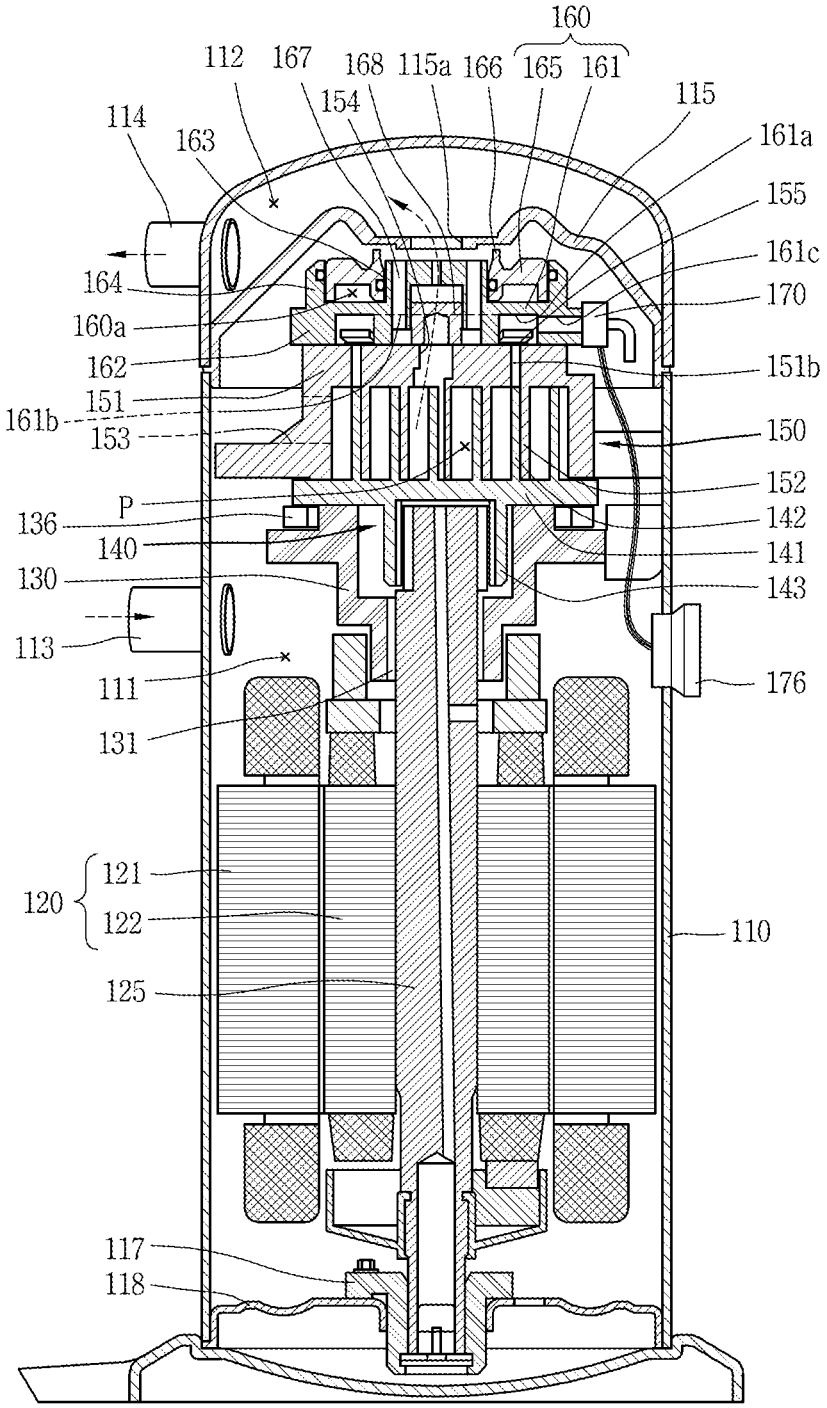
FIG. 3 is a longitudinal sectional view illustrating a scroll compressor having a capacity varying apparatus in accordance with the present invention.
Figure 4:
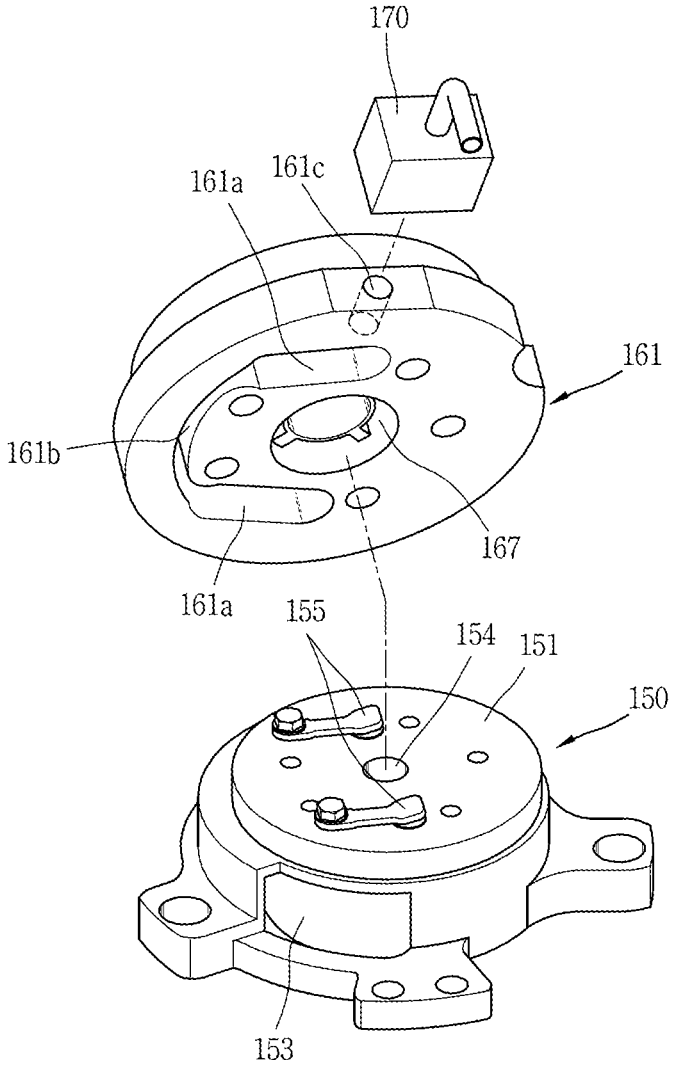
FIG. 4 is an exploded perspective view of the capacity varying apparatus according to FIG. 3.
Figure 5:
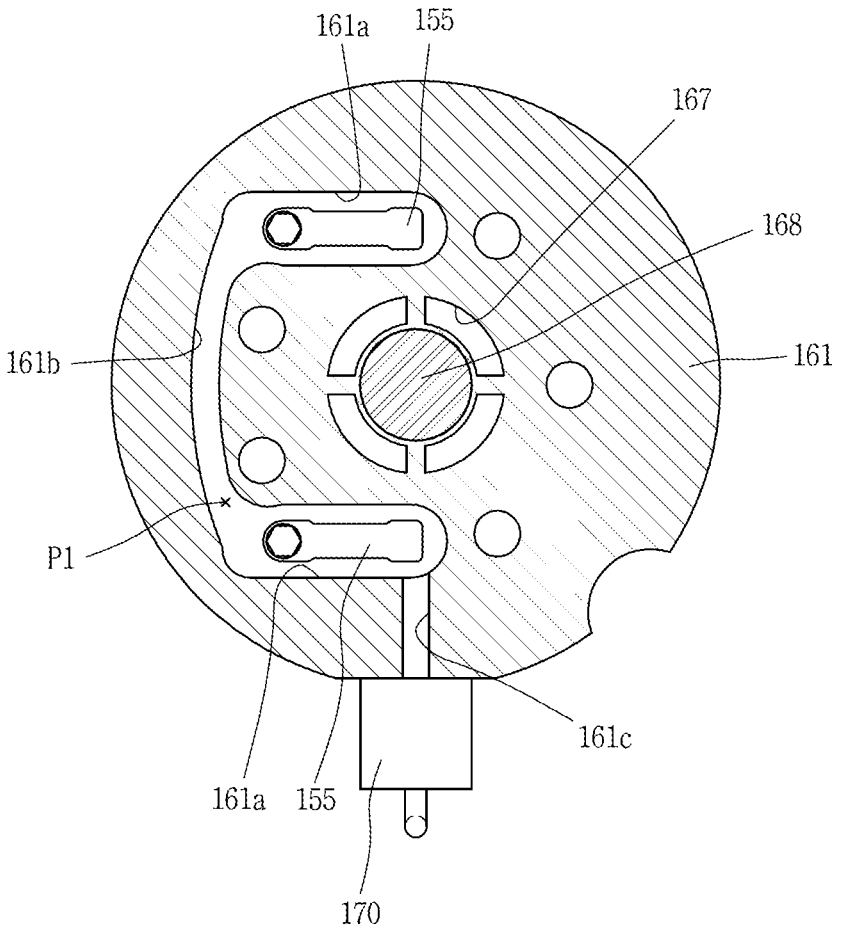
FIG. 5 is a sectional view taken along the line "VI-VI" of FIG. 3.
Figure 6A:
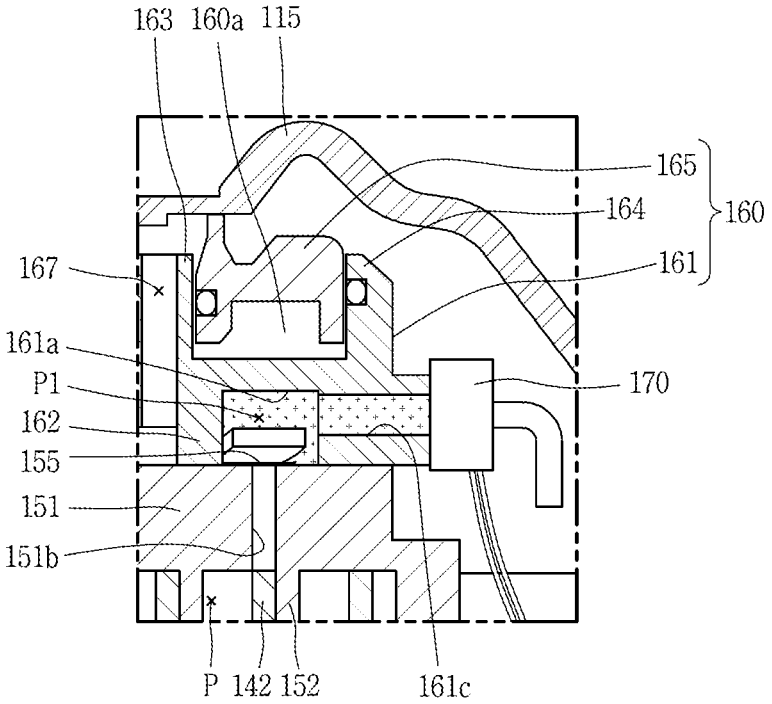
FIGS. 6A and 6B are longitudinal sectional views illustrating a power-operation state and a saving-operation state using the capacity varying apparatus in the scroll compressor of FIG. 3.
Figure 6B:
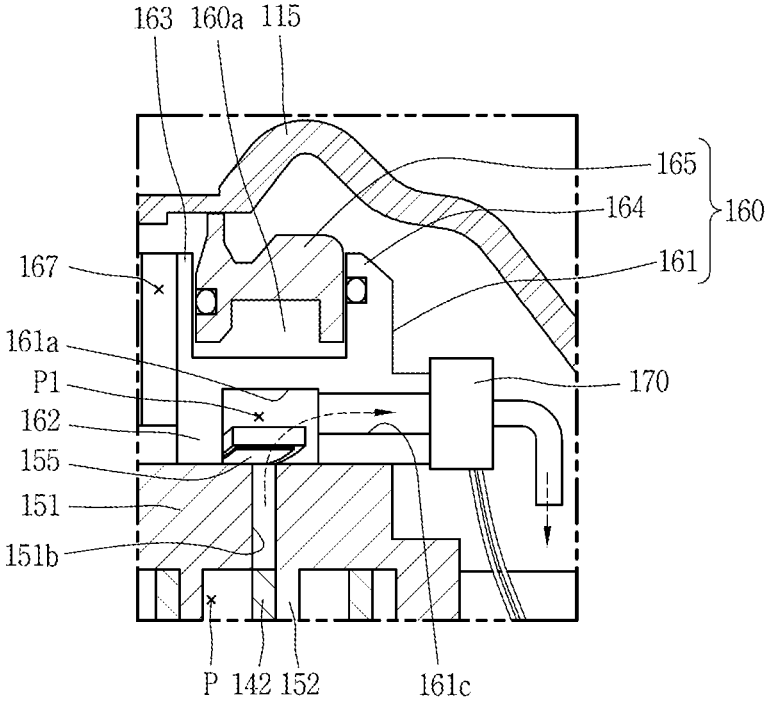

FIG. 3 is a longitudinal sectional view illustrating a scroll compressor having a capacity varying apparatus in accordance with the present invention, FIG. 4 is an exploded perspective view of the capacity varying apparatus according to FIG. 3, FIG. 5 is a sectional view taken along the line "VI-VI" of FIG. 3, and FIGS. 6A and 6B are longitudinal sectional views illustrating a power-operation state and a saving-operation state using the capacity varying apparatus in the scroll compressor of FIG. 3.

As illustrated in FIG. 3, a scroll compressor according to this embodiment is configured such that a hermetic inner space of a casing 110 is divided into a low pressure portion 111 as a suction space and a high pressure portion 112 as a discharge space by a high/low pressure dividing plate 115, which is provided on an upper side of a non-orbiting scroll 150 to be explained later. Here, the low pressure portion 111 corresponds to a lower space of the high/low pressure dividing plate 115, and the high pressure portion 112 corresponds to an upper space of the high/low pressure dividing plate 115.

A suction pipe 113 communicating with the low pressure portion 111 and a discharge pipe 114 communicating with the high pressure portion 112 are fixed to the casing 110, respectively, such that a refrigerant can be sucked into the inner space of the casing 110 or discharged out of the casing 110.

The low pressure portion 111 of the casing 110 is provided with a driving motor 120 having a stator 121 and a rotor 122. The stator 121 is fixed to an inner wall surface of the casing 100 in a shrink-fitting manner, and a rotation shaft 125 is inserted into a central portion of the rotor 122. A coil 121*a* is wound on the stator 121.

A lower side of the rotation shaft 125 is rotatably supported by an auxiliary bearing 117 provided on a lower portion of the casing 110. The auxiliary bearing 117 is supported by a lower frame 118 fixed to an inner surface of the casing 110 and thus can stably support the rotation shaft 125. The lower frame 118 may be welded on an inner wall surface of the casing 110. A bottom surface of the casing 110 is used as an oil storage space. Oil stored in the oil storage space is carried upwardly by the rotation shaft 125 and the like and thus introduced into a driving unit and the compression chamber for facilitating lubrication.

An upper end portion of the rotation shaft 125 is rotatably supported by a main frame 130. The main frame 130, similar to the lower frame 118, is fixed to the inner wall surface of the casing 110. A main bearing portion 131 downwardly protrudes from a lower surface of the main frame 130, and the rotation shaft 125 is inserted into the main bearing portion 131. An inner wall surface of the main bearing portion 131 serves as a bearing surface, and supports the rotation shaft 125 together with the oil, such that the rotation shaft 125 can smoothly rotate.

An orbiting scroll 140 is disposed on an upper surface of the main frame 130. The orbiting scroll 140 includes a disk portion 141 having a shape similar to a disk, and an orbiting wrap 142 spirally formed on one side surface of the disk portion 141. The orbiting wrap 142 forms the compression chambers P together with a non-orbiting wrap 152 of the non-orbiting scroll 150 to be explained later.

The disk portion 141 of the orbiting scroll 140 orbits in a state of being supported by the upper surface of the main frame 130. An Oldham-ring 136 is interposed between the disk portion 141 and the main frame 130 to prevent self-rotation of the orbiting scroll 140.

A boss 143 in which the rotation shaft 125 is inserted is formed on a lower surface of the disk portion 141 of the orbiting scroll 140, and accordingly the orbiting scroll 140 is orbited by the rotational force of the rotation shaft 125.

The non-orbiting scroll 150 engaged with the orbiting scroll 140 are disposed on the orbiting scroll 140. Here, the non-orbiting scroll 150 is provided to be movable up and down with respect to the orbiting scroll 140. In detail, the non-orbiting scroll 150 is supported with being laid on an upper surface of the main frame 130 in a manner that a plurality of guide pins (not illustrated) inserted into the main frame 130 are inserted in a plurality of guide holes (not illustrated) formed on an outer circumferential portion of the non-orbiting scroll 150.

Meanwhile, the non-orbiting scroll 150 includes a disk portion 151 formed in a disk shape on an upper surface of a body thereof, and the non-orbiting wrap 152 spirally formed on a lower portion of the disk portion 151 and engaged with the orbiting wrap 142 of the orbiting scroll 140.

A suction port 153 through which a refrigerant existing in the low pressure portion 111 is sucked is formed through a side surface of the non-orbiting scroll 150, and a discharge port 154 through which a compressed refrigerant is discharged is formed through an approximately central portion of the disk portion 151.

As aforementioned, the orbiting wrap 142 and the non-orbiting wrap 152 form a plurality of compression chambers P. The compression chambers are reduced in volume while orbiting toward the discharge port 154, thereby compressing the refrigerant. Therefore, the lowest pressure is existing in a compression chamber adjacent to the suction port 153, the highest pressure is existing in a compression chamber communicating with the discharge port 154, and pressure of a compression chamber present therebetween is intermediate pressure which has a value between suction pressure of the suction port 153 and discharge pressure of the discharge port 154. The intermediate pressure is applied to a back pressure chamber 160*a* to be explained later and serves to press the non-orbiting scroll 150 toward the orbiting scroll 140. Accordingly, a scroll-side back pressure hole, which communicates with one of areas having the intermediate pressure and through which the refrigerant is discharged, is formed on the disk portion 151.

A back pressure plate 161 which forms a part of the back pressure chamber assembly 160 is fixed to a top of the disk portion 151 of the non-orbiting scroll 150. The back pressure plate 161 is formed approximately in an annular shape, and provided with a supporting plate 162 which is brought into contact with the disk portion 151 of the non-orbiting scroll 150. The supporting plate 162 has a shape of an annular plate with a hollow center. Also, as illustrated in FIG. 5, a plate-side back pressure hole (not illustrated) communicating with the scroll-side back pressure hole is formed through the supporting plate 162.

First and second annular walls 163 and 164 are formed on an upper surface of the supporting plate 162 along an inner circumferential portion and an outer circumferential portion of the supporting plate 162. An outer circumferential surface of the first annular wall 163, an inner circumferential surface of the second annular wall 164 and the upper surface of the supporting plate 162 form the back pressure chamber 160*a* formed in the annular shape.

A floating plate 165 forming an upper surface of the back pressure chamber 160*a* is provided on an upper side of the back pressure chamber 160*a*. A sealing end portion 166 is disposed on an upper end portion of an inner space of the floating plate 165. In detail, the sealing end portion 166 upwardly protrudes from a surface of the floating plate 165, and has an inner diameter which is not so great to obscure an intermediate discharge port 167. The sealing end portion 166 comes in contact with a lower surface of the high/low pressure dividing plate 115, such that a discharged refrigerant can be discharged to the high pressure portion 112 without being leaked into the low pressure portion 111.

A non-explained reference numeral 168 denotes a check valve.

Hereinafter an operation of the scroll compressor according to the embodiment of the present invention will be described.

That is, when power is applied to the stator 121, the rotation shaft 125 rotates. The orbiting scroll 140 coupled to an upper end portion of the rotation shaft 125 performs an orbiting motion with respect to the non-orbiting scroll 150, in response to the rotation of the rotation shaft 125. Accordingly, a plurality of compression chambers P formed between the non-orbiting wrap 152 and the orbiting wrap 142 move toward the discharge port 154. During the movement, a refrigerant is compressed.

When the compression chamber P communicates with the scroll-side back pressure hole (not illustrated) before arriving at the discharge port 154, the refrigerant is partially introduced into the plate-side back pressure hole (not illustrated) formed through the supporting plate 162, which results in applying intermediate pressure to the back pressure chamber 160*a* that is formed by the back pressure plate 161 and the floating plate 165. Accordingly, the back pressure plate 161 is affected by pressure applied in a downward direction and the floating plate 165 is affected by pressure applied in an upward direction.

Here, since the back pressure plate 161 is coupled to the non-orbiting scroll 150 by a bolt, the intermediate pressure of the back pressure chamber 160*a* also affects the non-orbiting scroll 150. However, the non-orbiting scroll 150 is unable to be moved downward due to already being brought into contact with the disk portion 141 of the orbiting scroll 140, and thus the floating plate 165 is moved upward. The floating plate 165 prevents a leakage of the refrigerant from the discharge space as the high pressure portion 112 into the suction space as the low pressure portion 111, in response to the sealing end portion 166 thereof being brought into contact with a lower end portion of the high/low pressure dividing plate 115. In addition, the non-orbiting scroll 150 is pushed toward the orbiting scroll 140 by the pressure of the back pressure chamber 160*a*, thereby blocking the leakage of the refrigerant between the orbiting scroll 140 and the non-orbiting scroll 150.

When a capacity varying apparatus is applied to the scroll compressor according to this embodiment, bypass holes 151*b* that communicate with the intermediate pressure chamber are formed through the disk portion 151 of the non-orbiting scroll 150 in a direction from the intermediate pressure chamber toward a rear surface of the disk portion 151. The bypass holes 151*b* are formed with an interval of 180° with facing each other such that refrigerants with the same intermediate pressure in inner and outer pockets can be bypassed. However, when a wrap length of the orbiting wrap 142 is asymmetrically longer by 180° than a wrap length of the non-orbiting wrap 152, the same pressure is generated at the same crank angle in the inner pocket and the outer pocket. Therefore, the two bypass holes 151*b* may be formed at the same crank angle or only one bypass hole may be formed such that both of the inner and outer pockets communicate with each other.

A check valve 155 for opening and closing the bypass hole 151*b* is provided at each of the bypass holes 151*b*. The check valve 155 may be configured as a reed valve which is opened and closed according to pressure of the intermediate pressure chamber.

As illustrated in FIGS. 4 and 5, a plurality of valve accommodation grooves 161*a* in which the check valves 155 are accommodated, respectively, are formed on a lower surface of the back pressure plate 161 corresponding to the rear surface of the disk portion 151 of the non-orbiting scroll 150. The plurality of valve accommodation grooves 161*a* may communicate with each other through a communication groove 161*b*.

One end of a discharge hole 161*c* for guiding a bypassed refrigerant into the suction space as the low pressure portion 111 of the casing 110 is connected to one of the plurality of valve accommodation grooves 161*a* or the communication groove 161*b*. Another end of the discharge hole 161*c* penetrates through an outer circumferential surface of the back pressure plate 161. Accordingly, when the valve accommodation grooves 161*a*, the communication groove 161*b* and the discharge hole 161*c* form the intermediate pressure chamber P1, in which a refrigerant of intermediate pressure is stored, when the check valves 155 are open.

A control valve 170 is provided on an outer circumferential surface of the back pressure plate 161. The control valve 170 communicates with an end portion of the discharge hole 161*c* and selectively opens and closes the discharge hole 161*c* according to an operating mode of the compressor.

The control valve 170 may be configured as a solenoid valve that operates according to supply or non-supply of external power. The control valve 170 may be electrically connected to a separate terminal 176 provided in the casing 110.

In the scroll compressor according to this embodiment, during a power operation mode, as illustrated in FIG. 6A, the control valve 170 is maintained in a closed state. In this state, a refrigerant within the intermediate pressure chamber of the compression chamber P is partially discharged into the valve accommodation groove 161*a* through the bypass hole 151*b* in a manner of opening the check valve 155. This refrigerant remains in a state of being filled in the valve accommodation groove 161*a*, the communication groove 161*b* and the discharge hole 161*c*. Accordingly, the refrigerant does not flow out of the compression chamber P any more, which results in continuing the power operation of the compressor.

On the other hand, during a saving operation mode, as illustrated in FIG. 6B, when the check valve 155 is open, the refrigerant filled in the valve accommodation groove 161*a*, the communication groove 161*b* and the discharge hole 161*c* is fast discharged into the suction space as the low pressure portion 111. Then, a part of the refrigerant within the intermediate pressure chamber of the compression chamber is continuously discharged along the path, thereby continuing the saving operation of the compressor.

As such, the capacity varying apparatus may include the check valve and the control valve, which may result in reducing a number of components and simplifying a path for bypassing the refrigerant, thereby facilitating fabrication processes.

Also, the control valve can be installed on an end portion of a passage. Accordingly, the refrigerant may already stay near an outlet port of the passage when a power operation is switched into a saving operation, which may thus allow for fast switching into the saving operation that much.

Figure 7:
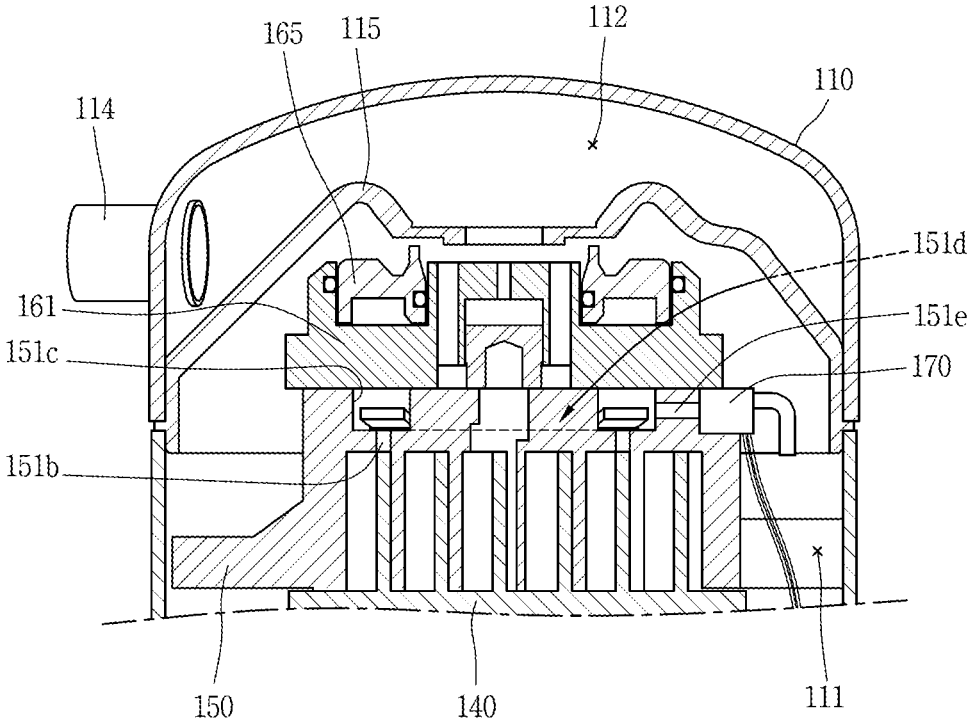
FIG. 7 is a longitudinal sectional view illustrating an example that the capacity varying apparatus is provided on a non-orbiting scroll in the scroll compressor according to FIG. 3.

Meanwhile, the valve accommodation grooves, the communication groove and the discharge hole may be formed on a rear surface of the disk portion 151 of the non-orbiting scroll 150. That is, as illustrated in FIG. 7, a plurality of valve accommodation grooves 151*c* are recessed by predetermined depths into the rear surface of the disk portion 151 of the non-orbiting scroll 150, respectively, and a communication groove 151*d* is recessed by a predetermined depth between the plurality of valve accommodation grooves 151*c*. Also, a discharge hole 151*e* may be formed from the valve accommodation groove 151*c* or the communication groove 151*d* to the outer circumferential surface of the non-orbiting scroll 150 in a penetrating manner. Even when the valve accommodation grooves 151*c*, the communication groove 151*d* and the discharge hole 151*e* are formed on the rear surface of the disk portion 151 of the non-orbiting scroll 150, the basic construction and operation effects are the same as or similar to those of the aforementioned embodiment. However, as illustrated in this embodiment, when the valve accommodation grooves 151*c*, the communication groove 151*d* and the discharge hole 151*e* are formed on the rear surface of the disk portion 151 of the non-orbiting scroll 150, lengths of the bypass holes 151*b* may be reduced, thereby reducing a dead volume.

Hereinafter, another embodiment for a capacity varying apparatus for a scroll compressor according to the present invention will be described.

That is, the foregoing embodiment has illustrated that the control valve is coupled directly to the back pressure plate or the non-orbiting scroll, but this embodiment illustrates that the control valve is provided adjacent to the driving motor with a relatively wide extra space.

Figure 8:
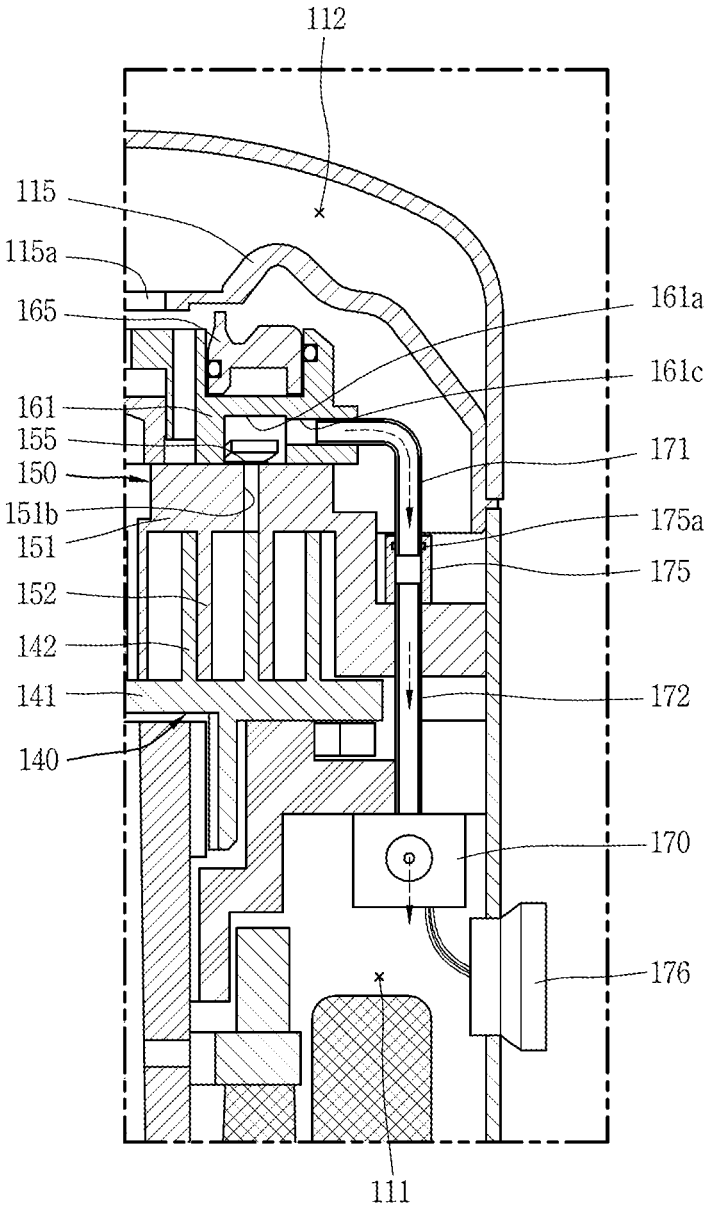
FIGS. 8 and 9 are illustrating longitudinal sectional views illustrating different embodiments each related to an installation position of a control valve constructing the capacity varying apparatus in the scroll compressor according to FIG. 3.

For example, as illustrated in FIG. 8, one end of a first communication pipe 171 is connected to the discharge hole 161*c*, and another end of the first communication pipe 171 is connected to one end of a second communication pipe 172, which penetrates through the main frame 130 and extends toward the driving motor 120 based on the main frame 130. The control valve 170 is disposed on another end of the second communication pipe 172. The control valve 170 may be fixed to a lower surface of the main frame 130 to be electrically connected to the terminal 176 separately provided through the casing 110.

In this instance, as the non-orbiting scroll 150 and the back pressure plate 161 coupled to the non-orbiting scroll 150 are disposed to be movable in an axial direction, when the first communication pipe 171 and the second communication pipe 172 are coupled into an integral form, the control valve 170 cannot be fixed to a fixed member such as the main frame 130. Therefore, the first communication pipe 171 and the second communication pipe 172 may preferably be connected to each other by use of a connection member 175, which is provided between the two communication pipes to be slidable with respect to at least one of the two communication pipes in a lengthwise direction.

A sealing member 175*a* is preferably provided between an inner circumferential surface of the connection member 175 and an outer circumferential surface of the communication pipe 171 slidably coupled to the connection member 175.

The capacity varying apparatus according to this embodiment provides the same/like basic configuration and operation effects to the foregoing embodiment, so detailed description will be omitted. However, this embodiment may allow the control valve 170 to be installed in a relatively wide space, compared to the foregoing embodiment, thereby relaxing restriction for the specification of the control valve 170.

Hereinafter, another embodiment of a capacity varying apparatus for a scroll compressor according to the present invention will be described.

That is, the foregoing embodiments have illustrated that the control valve is provided in the inner space of the casing, but this embodiment illustrates that the control valve is provided outside the casing.

Figure 9:
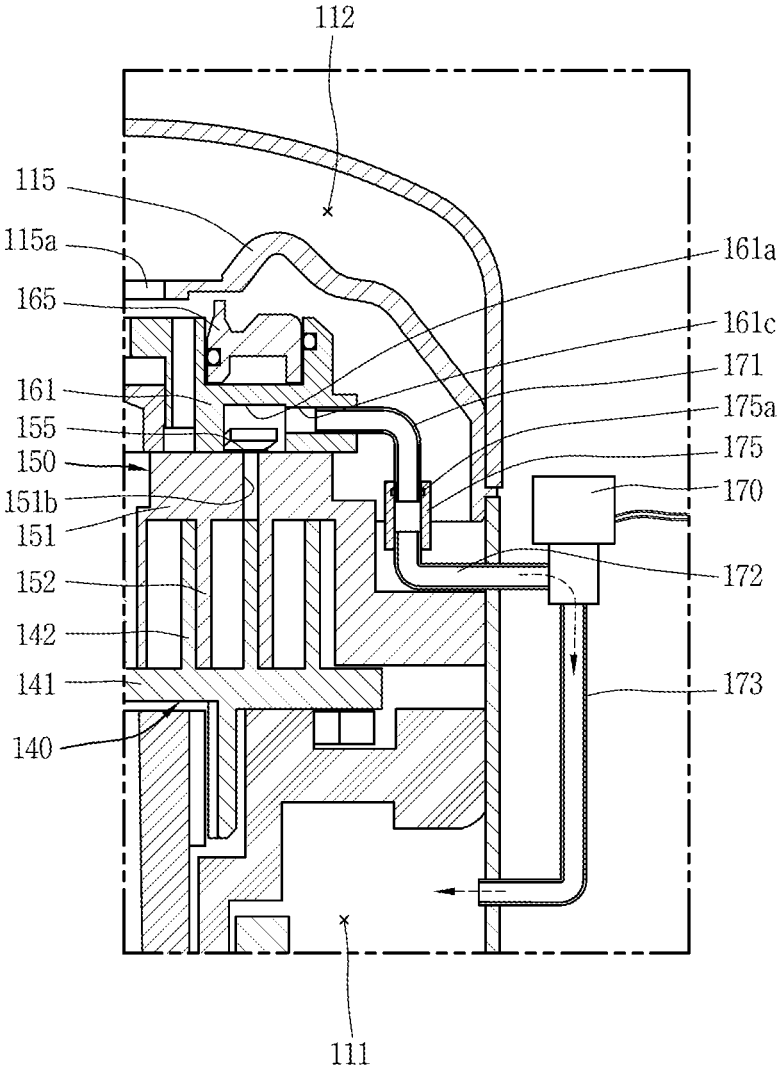

For example, as illustrated in FIG. 9, one end of the first communication pipe 171 is connected to the discharge hole 161*c*, and another end of the first communication pipe 171 is connected to one end of the second communication pipe 172 that externally extends through the casing 110. Another end of the second communication pipe 172 is connected to an inlet side of the control valve 170 at the outside of the casing 110, and an outlet side of the control valve 170 is connected one end of a third communication pipe 173. An outlet of the third communication pipe 173 is coupled through the casing 110 to communicate with the low pressure portion 111 of the casing 110.

Even in this instance, as the non-orbiting scroll 150 and the back pressure plate 161 are disposed to be movable in an axial direction, when the first communication pipe 171 and the second communication pipe 172 are coupled into an integral form, the control valve 170 cannot be fixed to a fixed member. Therefore, the first communication pipe 171 and the second communication pipe 172 may preferably be connected to each other by use of the connection member 175, which is provided between the two communication pipes 171 and 172 to be slidable with respect to at least one (the first communication pipe in the drawing) of the two communication pipes 171 and 172 in a lengthwise direction.

The sealing member 175*a* is preferably provided between an inner circumferential surface of the connection member 175 and an outer circumferential surface of the communication pipe 171 slidably coupled to the connection member 175.

The capacity varying apparatus according to this embodiment provides the same/like basic configuration and operation effects to the foregoing embodiment, so detailed description will be omitted. However, this embodiment may allow the control valve 170 to be connected directly to an external power source, by virtue of coupling the control valve to the outside of the casing. Accordingly, any separate terminal does not need to be mounted to the casing 110, thereby simplifying a structure for electrically connecting the control valve 170 that much.

Meanwhile, the scroll compressor continuously operates while a gap between the high pressure portion and the low pressure portion is blocked. When a usage environmental condition for the compressor is changed, temperature of the discharge space of the high pressure portion may increase up to a preset temperature or more. In this instance, some components of the compressor may be damaged due to such high temperature.

Figure 10:
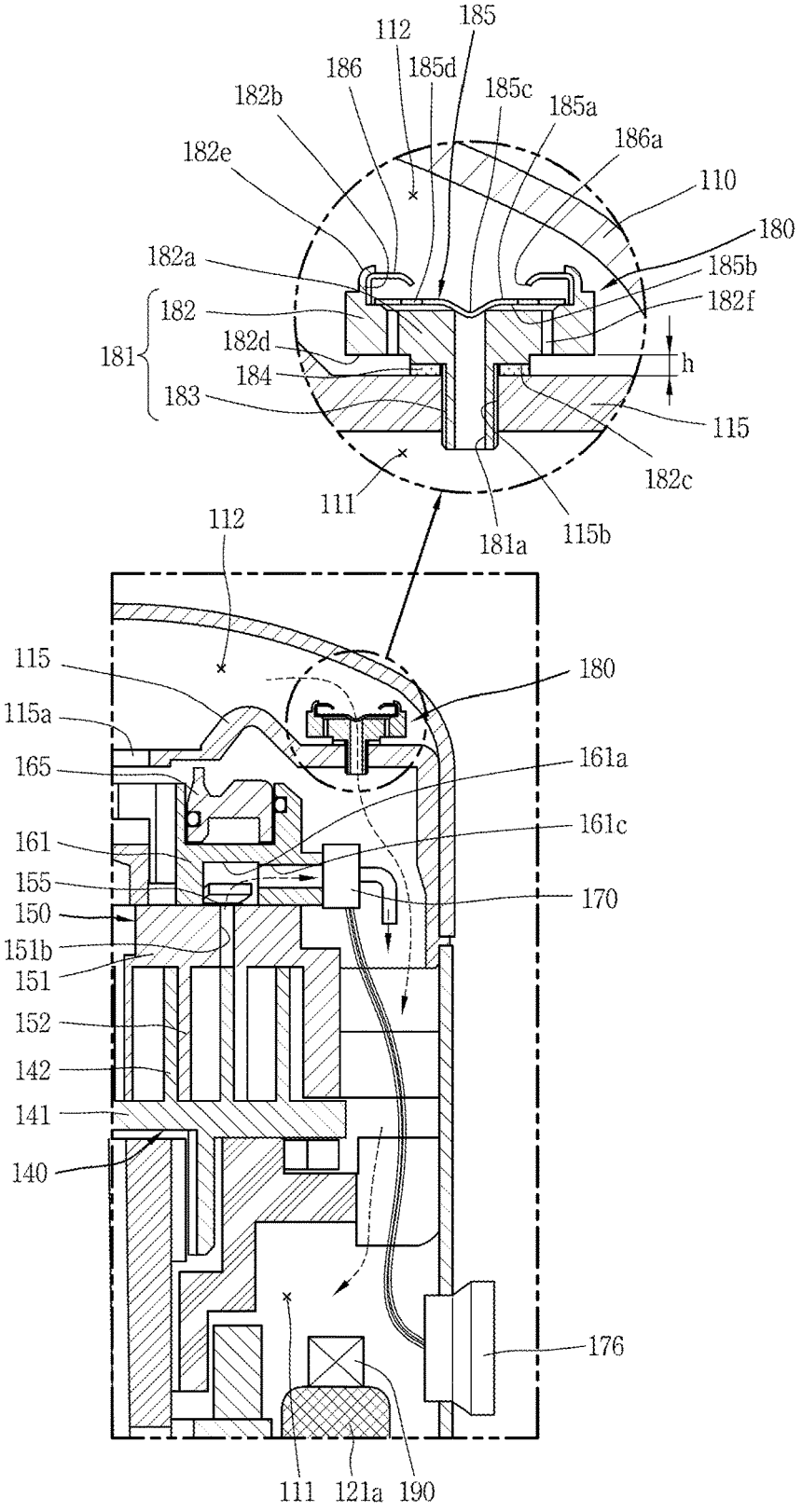
FIG. 10 is a longitudinal sectional view illustrating an example that an overheat preventing unit is provided in the scroll compressor according to FIG. 3.

Considering this, as illustrated in FIG. 10, an overheat preventing unit 180 may be disposed on the high/low pressure dividing plate 115 according to this embodiment. The overheat preventing unit 180 according to this embodiment may communicate the high pressure portion 112 and the low pressure portion 111 with each other such that a refrigerant of the high pressure portion 112 is leaked into the low pressure portion 111, when temperature of the high pressure portion 112 is raised up to a preset temperature or more. The leaked hot refrigerant arouses an operation of an overload breaker 121*b* provided on an upper end of the winding coil 121*a* of the stator 121, thereby stopping the operation of the compressor. Therefore, the overheat preventing unit 180 is preferably configured to be sensitive to temperature of the discharge space.

The overheat preventing unit 180 according to this embodiment may be spaced apart from the high/low pressure dividing plate 115 by a predetermined interval, if possible, taking into account the point that the high/low pressure dividing plate 115 is formed of a thin plate material and divides the high pressure portion 112 and the low pressure portion 111. This may allow the overheat preventing unit 180 to be less affected in view of temperature by the low pressure portion 111 with relatively low temperature.

In more detail, the overheat preventing unit 180 according to this embodiment may be provided with a body 181 which is separately fabricated to accommodate a valve plate 185, and the body 181 may then be coupled to the high/low pressure dividing plate 115. Accordingly, the high/low pressure dividing plate and the valve plate may be spaced apart from each other by a predetermined interval, such that the valve plate can be less affected by the high/low pressure dividing plate.

The body 181 may be made of the same material as the high/low pressure dividing plate 115. However, the body 181 may preferably be made of a material with a low heat transfer rate, in terms of insulation. The body 181 may be provided with a valve accommodating portion 182 having a valve space, and a coupling portion 183 protruding from a center of an outer surface of the valve accommodating portion 182 by a predetermined length and coupling the body 181 to the high/low pressure dividing plate 115.

The valve accommodating portion 182 includes a mounting portion 182*a* formed in a disk-like shape and having the valve plate 185 mounted on an upper surface thereof, and a side wall portion 182*b* extending from an edge of the mounting portion 182*a* into an annular shape and forming the valve space together with an upper surface of the mounting portion 182*a*. The mounting portion 182*a* may be thicker than the side wall portion 182*b* in thickness. However, when the mounting portion is thicker, an effect of holding heat may be generated. Therefore, the thickness of the mounting portion may alternatively be thinner than that of the side wall portion within a range of ensuring reliability.

A stepped surface 182*c* supported by the high/low pressure dividing plate 115 is formed on a lower surface of the mounting portion 182*a*. Accordingly, a lower surface of an outer mounting portion 182*d* which is located outside the stepped surface 182*c* of the lower surface of the mounting portion 182*a* may be spaced apart from an upper surface of the high/low pressure dividing plate 115 by a predetermined height (interval) h. This may result in reducing a contact area between the body and the high/low pressure dividing plate and simultaneously enhancing reliability by allowing a refrigerant of the discharge space to be introduced between the body and the high/low pressure dividing plate.

However, an insulating material, such as a gasket 194, which serves as a sealing member, may preferably be provided between the stepped surface 182*c* and the high/low pressure dividing plate 115, in the aspect of preventing heat transfer between the body 181 and the high/low pressure dividing plate 115.

Also, a communication hole 181*a* through which the high pressure portion 112 and the low pressure portion 111 communicate with each other is formed from a center of the upper surface of the mounting portion 182*a* to a lower end of the coupling portion 183. A damper (not illustrated) in which a sealing protrusion 185*c* of the valve plate 185 is inserted may be formed in a tapering manner on an inlet of the communication hole 181*a*, namely, an end portion of the upper surface of the mounting portion 182*a*.

A supporting protrusion 182*e* is formed on an upper end of the side wall portion 182*b*. The supporting protrusion 182*e* is bent after inserting a valve stopper 186 therein, so as to support the valve stopper 186. The valve stopper 186 may be formed in a ring shape with a first gas hole 186*a* formed at a center thereof to allow a refrigerant of the high pressure portion 112 to always come in contact with a first contact surface 185*a* of the valve plate 185.

Here, the mounting portion 182*a* may be provided with at least one second gas hole 182*f* through which the refrigerant of the high pressure portion 112 always comes in contact with a second contact surface 185*b* of the valve plate 185. Accordingly, the refrigerant of the discharge space may come in contact directly with the first contact surface 185*a* of the valve plate 185 through the first gas hole 186*a* and simultaneously come in contact directly with the second contact surface 185*b* of the valve plate 185 through the second gas hole 182*f*. This may result in reducing a temperature difference between the first contact surface 185*a* and the second contact surface 185*b* of the valve plate 185 and simultaneously increasing a responding speed of the valve plate 185.

The valve plate 185 may be configured as a bimetal to be thermally transformed according to temperature of the high pressure portion 112 and thereby open and close the communication hole 181*a*. The sealing protrusion 185*c* protrudes from a central portion of the valve plate 185 toward the communication hole 181*a*, and a plurality of refrigerant holes 185*d* through which the refrigerant flows during an opening operation are formed around the sealing protrusion 185*c*.

Meanwhile, a thread is formed on an outer circumferential surface of the coupling portion 183 such that the coupling portion 183 can be screw-coupled to a coupling hole 115*b* provided on the high/low pressure dividing plate 115. However, in some cases, the coupling portion 183 may be press-fitted into the coupling hole 115*b* or coupled to the coupling hole 115*b* in a welding manner or by using an adhesive.

The overheat preventing unit 180 of the scroll compressor according to this embodiment may extend a path along which low refrigerant temperature of the low pressure portion 111 is transferred to the valve plate 185 by a heat transfer through the high/low pressure dividing plate 115, which may increase an insulating effect and accordingly allow the valve plate 185 to be much less affected by the temperature of the low pressure portion 111.

On the other hand, the valve plate 185 may be located in the discharge space of the high pressure portion 122 by being spaced apart from the upper surface 115*c* of the high/low pressure dividing plate 115, adjacent to the high pressure portion 112, by the predetermined height h. Accordingly, the valve plate 185 may be mostly affected by the temperature of the high pressure portion 112, and thus sensitively react with respect to the increase in the temperature of the high pressure portion 112.

Accordingly, when the temperature of the high pressure portion increases up to a set value or more, the valve plate may fast be open and the refrigerant of the high pressure portion may fast flow toward the low pressure portion through the bypass holes. The refrigerant arouses the operation of the overload breaker provided in the driving motor and thereby the compressor is stopped. With the configuration, the overheat preventing unit can correctly react with the operating state of the compressor without distortion, thereby preventing damage on the compressor due to high temperature in advance.

The foregoing embodiments have exemplarily illustrated a low pressure type scroll compressor, but the present invention can be equally applied to any hermetic compressor in which an inner space of a casing is divided into a low pressure portion as a suction space and a high pressure portion as a discharge space.

It should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Therefore, an aspect of the detailed description is to provide a scroll compressor capable of reducing fabricating costs by simplifying a structure of a capacity varying apparatus.

Another aspect of the detailed description is to provide a scroll compressor capable of relaxing restrictions on components constructing a capacity varying apparatus.

Another aspect of the detailed description is to provide a scroll compressor capable of easily supplying power for operating a capacity varying apparatus.

Another aspect of the detailed description is to provide a scroll compressor capable of enhancing responsiveness by simplifying a control of a capacity varying apparatus.

To achieve these and other advantages and in accordance with the purpose of this specification, as embodied and broadly described herein, there is provided a scroll compressor having a high/low pressure dividing plate for dividing an inner space of a casing into a high pressure portion and a low pressure portion, the compressor including a passage formed between a non-orbiting scroll and a back pressure chamber assembly to communicate with an intermediate pressure chamber, and a valve provided at the passage to open and close the passage.

Here, the scroll compressor may further include a check valve disposed at the passage and opened and closed according to a pressure difference of the intermediate pressure chamber.

To achieve these and other advantages and in accordance with the purpose of this specification, as embodied and broadly described herein, there is provided a scroll compressor, comprising: a casing having a hermetic inner space that includes a low pressure portion and a high pressure portion; an orbiting scroll disposed within the inner space of the casing, and the orbiting scroll to perform an orbiting motion; a non-orbiting scroll, wherein the orbiting member and non-orbiting member to form a compression chamber, the compression chamber having a suction chamber, an intermediate pressure chamber and a discharge chamber; a back pressure chamber assembly coupled to the non-orbiting scroll; a valve accommodation groove provided on at least one of the non-orbiting scroll or the back pressure chamber assembly; a bypass hole provided from the intermediate pressure chamber to the valve accommodation groove; a check valve at the valve accommodation groove, and the check value to open or close the bypass hole based on pressure at the intermediate pressure chamber; a communication passage between the valve accommodation groove and the low pressure portion of the casing; and a control valve to selectively open and close the communication passage.

Here, the bypass hole includes a plurality of bypass holes spaced apart from each other, and wherein the check valve includes a plurality of check valves to open and close the plurality of bypass holes, respectively.

The valve accommodation groove includes a plurality of valve accommodation groove, wherein the plurality of check valves to be provided in the plurality of valve accommodation grooves, respectively, and wherein a communication groove is provided between two of the plurality of valve accommodation grooves to communicate between the two of the plurality of valve accommodation grooves.

The control valve is disposed within the inner spacing of the casing.

The control valve is electrically connected to a terminal mounted at the casing.

The control valve is coupled, at the communication passage, to the non-orbiting scroll or the back pressure chamber assembly.

Comprising a communication pipe having a first end and a second end, wherein the communication passage is coupled to the first end of the communication pipe that extends into the inner space of the casing, and the second end of the communication pipe that extends through the non-orbiting scroll, and wherein the control valve is disposed at the second end of the communication pipe.

The non-orbiting scroll is to move up and down with respect to the orbiting scroll, wherein the communication pipe includes a plurality of communication pipes, and a connection member is coupled between two of the plurality of communication pipes, and wherein the connection member is slidably coupled to a portion of a first one of the communication pipes.

Comprising a sealing member provided between an inner surface of the connection member and an outer surface of the communication pipe.

Comprising a communication pipe, wherein the communication passage is coupled to a first end of the communication pipe that extends to outside of the casing, and a second end of the communication pipe is coupled to the low pressure portion of the casing, and wherein the control valve is disposed at the communication pipe at the outside of the casing.

The communication pipe includes a plurality of communication pipes, and at least two of the plurality of communication pipes are coupled by a connection member, and wherein the connection member is slidably coupled to at least one communication pipe.

Comprising a sealing member provided between an inner surface of the connection member and an outer surface of the communication pipe.

The control valve is connected directly to an external power source.

To achieve these and other advantages and in accordance with the purpose of this specification, as embodied and broadly described herein, there is provided a scroll compressor, comprising: a casing; a high/low pressure dividing plate attached to an inner space of the casing to separate the inner space of the casing into a low pressure portion and a high pressure portion; a main frame spaced from the high/low pressure dividing plate; an orbiting scroll at the main frame to perform an orbiting motion; a non-orbiting scroll to move up and down with respect to the orbiting scroll, and the non-orbiting scroll to form, along with the orbiting scroll, a suction chamber, an intermediate pressure chamber and a discharge chamber; a back pressure plate attached to the non-orbiting scroll, and the back pressure plate having a space portion to communicate with the intermediate pressure chamber and having an open surface to face the high/low pressure dividing plate; and a floating plate movably coupled to the back pressure plate to hermetically seal the space portion and form a back pressure chamber, wherein the non-orbiting scroll includes: a plurality of bypass holes formed from the intermediate pressure chamber to a surface of the non-orbiting scroll facing the back pressure plate, and check valves at the surface of the non-orbiting scroll for opening and closing the bypass holes, respectively, wherein a communication groove is provided on at least one of the surface of the non-orbiting scroll or a surface of the back pressure plate corresponding to the surface of the non-orbiting scroll, wherein a discharge hole to communicate between the communication groove and the low pressure portion is provided at one of the non-orbiting scroll or the back pressure plate, and wherein a control valve is provided at the discharge hole to selectively open and close the discharge hole to communicate between the intermediate pressure chamber and the low pressure portion of the casing.

Here, the control valve is coupled to a member with the discharge hole of the non-orbiting scroll or the back pressure plate.

Comprising a communication pipe, wherein the discharge hole is coupled to a first end of the communication pipe that extends toward the low pressure portion, and a second end of the communication pipe extends through the main frame, and wherein the control valve is disposed at the second end of the communication pipe.

Comprising a communication pipe, wherein the discharge hole is coupled to a first end of the communication pipe that extends to outside of the casing, and a second end of the communication pipe is coupled to the low pressure portion of the casing, and wherein the control valve is disposed at the communication pipe at the outside of the casing.

To achieve these and other advantages and in accordance with the purpose of this specification, as embodied and broadly described herein, there is provided a scroll compressor, comprising: a casing having an inner space; a high/low pressure dividing plate to separate the inner space of the casing into a low pressure portion and a high pressure portion; an orbiting member disposed within the casing, and the orbiting member to perform an orbiting motion; a non-orbiting member, wherein the orbiting member and the non-orbiting member to form a compression chamber, the compression chamber including a suction chamber, an intermediate pressure chamber and a discharge chamber; a passage disposed at the non-orbiting member to communicate between an inside of the compression chamber and an outside of the compression chamber; and an opening/closing valve assembly disposed at outside of the non-orbiting member, and the opening/closing valve to open and close the passage.

Here, the opening/closing valve assembly is disposed within the casing.

The opening/closing valve assembly is disposed outside of the casing.

A scroll compressor according to the present invention may use a less number of components by virtue of installing a check valve in a bypass hole and also simplify a bypass passage for bypassing a refrigerant by virtue of installing a control valve on the bypass hole. This may result in facilitating fabrication of a capacity varying apparatus.

As a control valve is installed on a passage, a refrigerant may be in a state of being already arrived at an outlet of the passage when switching a power operation mode into a saving operation mode, which may allow for fast switching into the saving operation mode.

Also, a position of a control valve may be changed by using a communication pipe, and thus restriction on a specification of the control valve can be relaxed. This may result in enhancing reliability of a capacity varying apparatus.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a hermetic inner space that includes a low pressure portion and a high pressure portion;

an orbiting scroll disposed within the inner space of the casing, and the orbiting scroll to perform an orbiting motion;

a non-orbiting scroll, wherein the orbiting scroll and the non-orbiting scroll to form a compression chamber, the compression chamber having a suction chamber, an intermediate pressure chamber and a discharge chamber;

a back pressure chamber assembly coupled to the non-orbiting scroll;

a valve accommodation groove provided on the back pressure chamber assembly;

a bypass hole provided from the intermediate pressure chamber to the valve accommodation groove;

a check valve at the valve accommodation groove, and the check valve to open or close the bypass hole based on pressure at the intermediate pressure chamber;

a communication passage between the valve accommodation groove and the low pressure portion of the casing;

a control valve to selectively open and close the communication passage; and a communication pipe having a first end and a second end, wherein the communication passage is coupled to the first end of the communication pipe that extends into the inner space of the casing, and the second end of the communication pipe that extends through the non-orbiting scroll, and wherein the control valve is disposed at the second end of the communication pipe, and wherein the control valve is fixed to a lower surface of a main frame facing a driving motor.

2. The compressor of claim 1, wherein the bypass hole includes a plurality of bypass holes spaced apart from each other, and wherein the check valve includes a plurality of check valves to open and close the plurality of bypass holes, respectively.

3. The compressor of claim 2, wherein the valve accommodation groove includes a plurality of valve accommodation groove, wherein the plurality of check valves to be provided in the plurality of valve accommodation grooves, respectively, and wherein a communication groove is provided between two of the plurality of valve accommodation grooves to communicate between the two of the plurality of valve accommodation grooves.

4. The compressor of claim 1, wherein the control valve is electrically connected to a terminal mounted at the casing.

5. The compressor of claim 1, wherein the non-orbiting scroll is to move up and down with respect to the orbiting scroll, wherein the communication pipe includes a plurality of communication pipes, and a connection member is coupled between two of the plurality of communication pipes, and wherein the connection member is slidably coupled to a portion of a first one of the communication pipes.

6. The compressor of claim 5, comprising a sealing member provided between an inner surface of the connection member and an outer surface of the communication pipe.

7. A scroll compressor, comprising:

a casing;

a high/low pressure dividing plate attached to an inner space of the casing to separate the inner space of the casing into a low pressure portion and a high pressure portion;

a main frame spaced from the high/low pressure dividing plate;

an orbiting scroll at the main frame to perform an orbiting motion;

a non-orbiting scroll to move up and down with respect to the orbiting scroll, and the non-orbiting scroll to form, along with the orbiting scroll, a suction chamber, an intermediate pressure chamber and a discharge chamber;

a back pressure plate coupled to the non-orbiting scroll by a plurality of bolts, and the back pressure plate having a space portion to communicate with the intermediate pressure chamber and having an open surface to face the high/low pressure dividing plate; and a floating plate movably coupled to the back pressure plate to hermetically seal the space portion and form a back pressure chamber, wherein the non-orbiting scroll includes:

a plurality of bypass holes formed from the intermediate pressure chamber to a surface of the non-orbiting scroll facing the back pressure plate, and check valves at the surface of the non-orbiting scroll for opening and closing the bypass holes, respectively, wherein a communication groove is provided on at least one of the surface of the non-orbiting scroll or a surface of the back pressure plate corresponding to the surface of the non-orbiting scroll, wherein a discharge hole to communicate between the communication groove and the low pressure portion is provided at one of the non-orbiting scroll or the back pressure plate, wherein a control valve to communicate between the intermediate pressure chamber and the low pressure portion of the casing, wherein a communication pipe is coupled between the discharge hole and the control valve, wherein the discharge hole is coupled to a first end of the communication pipe that extends toward the low pressure portion of the casing, and a second end of the communication pipe extends through the main frame, and wherein the control valve is disposed at the second end of the communication pipe, and the control valve is fixed to a lower surface of the main frame facing a driving motor.

8. The compressor of claim 7, wherein the control valve is coupled to a member with the discharge hole of the non-orbiting scroll or the back pressure plate.

* * * * *